US007861339B2

(12) United States Patent
Harrow

(10) Patent No.: US 7,861,339 B2
(45) Date of Patent: Jan. 4, 2011

(54) BED BASE

(76) Inventor: Lawrence Harrow, 5959 Corvette St., Commerce, CA (US) 90040

( * ) Notice: Subject to any disclaimer, the term of this patent is extended or adjusted under 35 U.S.C. 154(b) by 0 days.

(21) Appl. No.: 12/189,699

(22) Filed: Aug. 11, 2008

(65) Prior Publication Data

US 2010/0031440 A1 Feb. 11, 2010

(51) Int. Cl.
*A47C 19/00* (2006.01)

(52) U.S. Cl. ..... 5/201; 5/282.1; 5/286; 5/288

(58) Field of Classification Search ..... 5/131, 5/200.1, 201, 282.1, 285, 286, 288, 292, 5/299, 304; 403/205, 403
See application file for complete search history.

(56) References Cited

U.S. PATENT DOCUMENTS

| | | | | |
|---|---|---|---|---|
| 1,566,709 | A | | 12/1925 | Wasserman |
| 1,915,215 | A | | 6/1933 | Carpenter |
| 2,544,274 | A | | 3/1951 | Moeller |
| 2,639,042 | A | | 5/1953 | Lambert et al. |
| 2,721,338 | A | | 10/1955 | Resnick |
| 3,123,837 | A | | 3/1964 | Paine et al. |
| 3,195,196 | A | * | 7/1965 | Carisi ..... 403/219 |
| 3,605,142 | A | | 9/1971 | Weinhart |
| 3,699,593 | A | | 10/1972 | Oetiker |
| 3,713,181 | A | | 1/1973 | Hougland |
| 3,730,108 | A | | 5/1973 | Stroh |
| 3,744,068 | A | | 7/1973 | Harris |
| 3,757,361 | A | | 9/1973 | Harris et al. |
| 3,760,437 | A | | 9/1973 | Hooker |
| 3,803,644 | A | | 4/1974 | Harris |
| 3,849,012 | A | | 11/1974 | Krouse |
| 3,945,064 | A | | 3/1976 | Harris et al. |
| 3,952,345 | A | | 4/1976 | Spitz |
| 4,078,270 | A | | 3/1978 | Nowell |
| RE29,611 | E | | 4/1978 | Lawrence |
| 4,106,141 | A | | 8/1978 | Hooker |
| 4,196,484 | A | * | 4/1980 | Harris ..... 5/201 |
| 4,224,704 | A | | 9/1980 | Nowell |
| 4,225,265 | A | | 9/1980 | Hooker et al. |
| 4,263,683 | A | | 4/1981 | Knoke |
| 4,276,665 | A | | 7/1981 | Mis |
| 4,444,323 | A | | 4/1984 | Travis |

(Continued)

FOREIGN PATENT DOCUMENTS

DE 37 19981 A1 12/1988

OTHER PUBLICATIONS

U.S. Appl. No. 11/326,816, filed Jan. 6, 2006, Harrow.

(Continued)

*Primary Examiner*—Robert G Santos
*Assistant Examiner*—Nicholas Polito
(74) *Attorney, Agent, or Firm*—John J. Connors; Connors & Assoc.

(57) ABSTRACT

A bed base comprises a rectangular support having side members connected at corners by a corner connector assembly including a locator element in a leg of a plate member that interacts with a locator element in a side member. A cross-rail assembly includes an elongated bar member that fits in notches in upper edge sections of opposed side members and a pair of leg members near opposed ends the elongated bar member pass through the notches upon attaching the cross-rail assembly to the rectangular support.

2 Claims, 6 Drawing Sheets

U.S. PATENT DOCUMENTS

| | | | | |
|---|---|---|---|---|
| 4,536,904 | A | 8/1985 | Whitehead | |
| 4,554,692 | A | 11/1985 | Whitehead | |
| 4,870,711 | A | 10/1989 | Felix | |
| 5,012,538 | A | 5/1991 | Timm | |
| 5,161,268 | A | 11/1992 | Harrow | |
| 5,920,930 | A | 7/1999 | Harrow | |
| 6,415,465 | B1 | 7/2002 | Harrow | |
| 6,711,765 | B1 * | 3/2004 | Mitchell et al. | 5/202 |
| 6,810,540 | B2 | 11/2004 | Harrow | |
| 6,865,758 | B2 | 3/2005 | Harrow | |
| 6,925,666 | B2 * | 8/2005 | Harrow | 5/201 |
| 7,155,762 | B2 * | 1/2007 | Harrow | 5/288 |
| 2005/0129460 | A1 * | 6/2005 | Medcalf et al. | 403/403 |
| 2008/0222801 | A1 | 9/2008 | Harrow | |
| 2008/0222802 | A1 | 9/2008 | Harrow | |

OTHER PUBLICATIONS

U.S. Appl. No. 12/189,699, filed Aug. 11, 2008, Harrow.
U.S. Appl. No. 12/351,351, filed Jan. 9, 2009, Harrow.
Leggett & Platt, Inc., New Stronger Three-Tube Bedbase Assembly Instructions, Apr. 17, 1986.
Voico Industries, Inc., Snap-Lock, The Ultimate Bed Base System.

* cited by examiner

BED BASE

INCORPORATION BY REFERENCE

Any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "rectangular" includes square.

BACKGROUND

U.S. Pat. Nos. 6,865,758; 6,925,666; and 7,155,762 disclose bed bases made from sheet metal and include side members connected at corners. One or more cross-rails span the width of the bed base, adding rigidity and support for a box spring and mattress. It is desirable to simplify the construction and assembly of the components of the bed base and reduce the cost of manufacture.

SUMMARY

My bed base has one or more of the features depicted in the embodiment discussed in the section entitled "DETAILED DESCRIPTION OF SOME ILLUSTRATIVE EMBODIMENTS." The claims that follow define my bed base, distinguishing it from the prior art; however, without limiting the scope of my bed base as expressed by these claims, in general terms, one or more, but not necessarily all, of its features are:

One, my bed base employs a unique corner connector assembly to attach together adjacent side members of my bed base. This corner connector assembly has a pair of plate members and means for attaching the plate members together. The plate members are formed by a stamping a sheet steel plug. The attaching means may be a post element, for example, an elongated rod that extends between upper and lower aligned plate members. The post element may have an enlarged head at one end and a threaded portion at an opposed end. The lower plate member may include a threaded receptacle that receives the threaded end of the elongated rod. In one embodiment, the upper and lower plate members are essentially identical, except for the threaded receptacle.

Two, each plate member may include a pair of arms at a right angle. The pair of arms may have outer wall elements along outer edges of each arm that are substantially at a right angle to each other and to the arm to which they are attached and inner wall elements along inner edges of each arm that are substantially at a right angle to each other and to the arm to which they are attached. These inner and outer wall elements form a right angle channel in the plate member. A locator element in each arm of the plate member is adapted to engage and interlock with a locator element in each side member end of adjacent side members. At least some of the locator elements may comprise holes, and at least some of the locator elements may comprise projections that fit snugly within the holes.

Three, the post element may extend between and fasten together the upper and lower plate members and the locator elements on the plate members are interactive with the locator elements on side members. These locator elements engage and interlock upon insertion of the planar support members of the side members into the right angle channel of the upper plate member and insertion of the lower planar support member into the right angle channel of the lower plate member. For example, the locator elements on the plate members may be hollow cylindrical projections formed by stamping. There is a pair of such cylindrical projections in each individual plate member, one received in a circular hole functioning as a locator element in each adjacent planar support member. The circular hole has a diameter only slightly greater than the diameter of the cylindrical locator element inserted therein during assembly of adjacent side members. Such interactive locator elements lock together the adjacent side members so they do not separate.

Four, in one embodiment my bed base is a combination of a unique cross-rail assembly and a substantially rectangular mattress support including at least one pair of opposed, substantially parallel side members separated by a predetermined distance. Each side member may have at least one notch in an upper edge section thereof, with the notches in the opposed side members being aligned. The leg members at or near the ends of the bar member are separated by substantially the predetermined distance between the side members so that each leg member is individually received within a notch. In other words, the leg members at or near the ends of the bar member are separated by a distance substantially equal to the predetermined distance between the opposed side members. The cross-rail assembly includes an elongated bar member that extends between the opposed side members and fits in the aligned notches, and at least a pair of leg members, one at or near each opposed end of the elongated bar member. Each leg member passes through one notch in one side member upon attaching a cross-rail assembly to the mattress support. The leg members extend from the bar member in the same direction substantially at a right angle to the bar member. Typically, a third leg member is centrally positioned between the leg members at or near the ends of the bar member. The leg members at or near the ends of the bar member provide rigidity and support for the side members through which they extend.

Five, each side member may include a planar support along an upper edge. The notches are cut into the planar support and the side member and may at least partially surround a leg member extending through the notch. Each notch is configured and dimensioned so an exterior surface of the elongated bar member is substantially flush with an exterior surface of the planar support member upon attaching the cross-rail assembly to the rectangular support. This may be achieved by forming an aperture in the upper edge of the side member. For example, an inner edge of the upper planar support member may terminate in an inwardly oriented foot element that is substantially at a right angle to the upper planar support member and substantially parallel to the side member. Each notch partially extends into the foot element as well as through the upper planar support member and its side member to form the aperture. This aperture has essentially the same overall configuration and dimensions as the cross-section of the leg member extending therethrough. In one embodiment, the bar member and leg members at or near the ends of the bar member each may have a substantially rectangular cross-sectional configuration of substantially the same dimensions and the apertures formed by the notches have a substantially rectangular cross-sectional configuration of substantially the same dimensions as the leg members at or near the ends of the bar member.

Six, each side member may have a lower planar support member opposed to the upper planar support member. The planar support members extend inwardly substantially at a right angle to the side member from which the planar support members extend. Each lower planar support member may have an opening therein aligned with the notch in the upper planar support member. The leg members have a predetermined length so that, upon attaching the cross-rail assembly to the rectangular support, each leg member terminates next to the opening aligned with the notch through which the leg member extends. Each leg member may terminate at a lower end in a slider element that is next to an exterior surface of the lower planar support member.

These features are not listed in any rank order nor is this list intended to be exhaustive.

DESCRIPTION OF THE DRAWING

One embodiment of my bed base is discussed in detail in connection with the accompanying drawing, which is for illustrative purposes only. This drawing includes the following figures (Figs.), with like numerals indicating like parts.

DETAILED DESCRIPTION OF SOME ILLUSTRATIVE EMBODIMENTS

Figure 1:
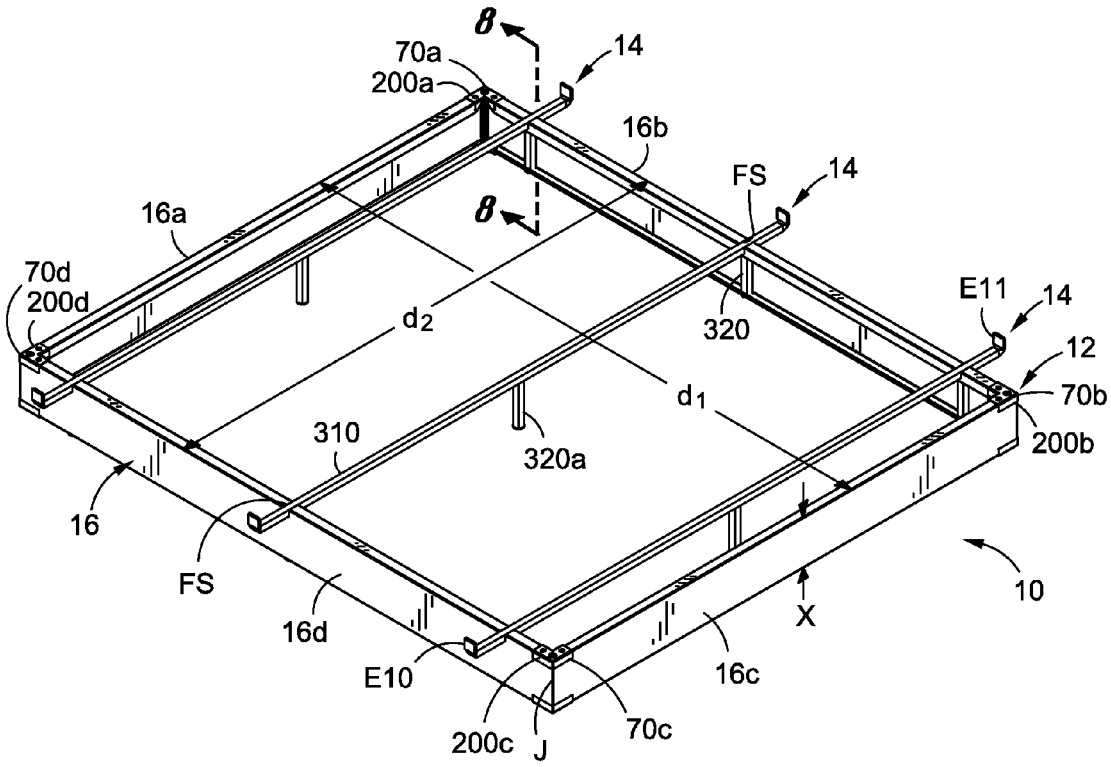
FIG. 1 is a perspective view of one embodiment of my bed base.
Figure 2:
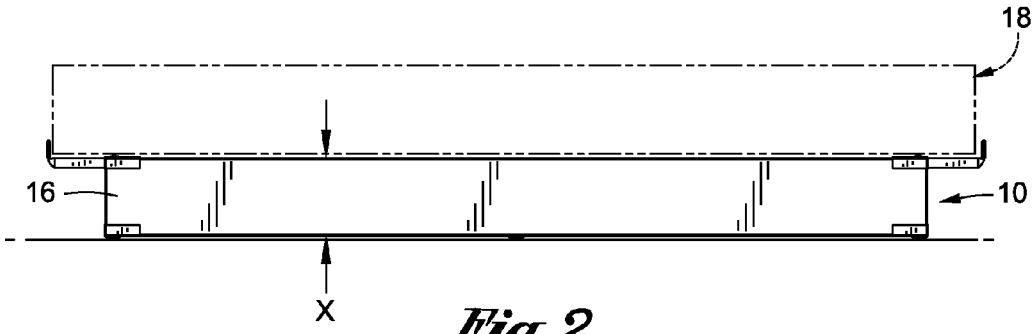
FIG. 2 is a side elevation view of the embodiment of my bed base shown in FIG. 1.
Figure 3:
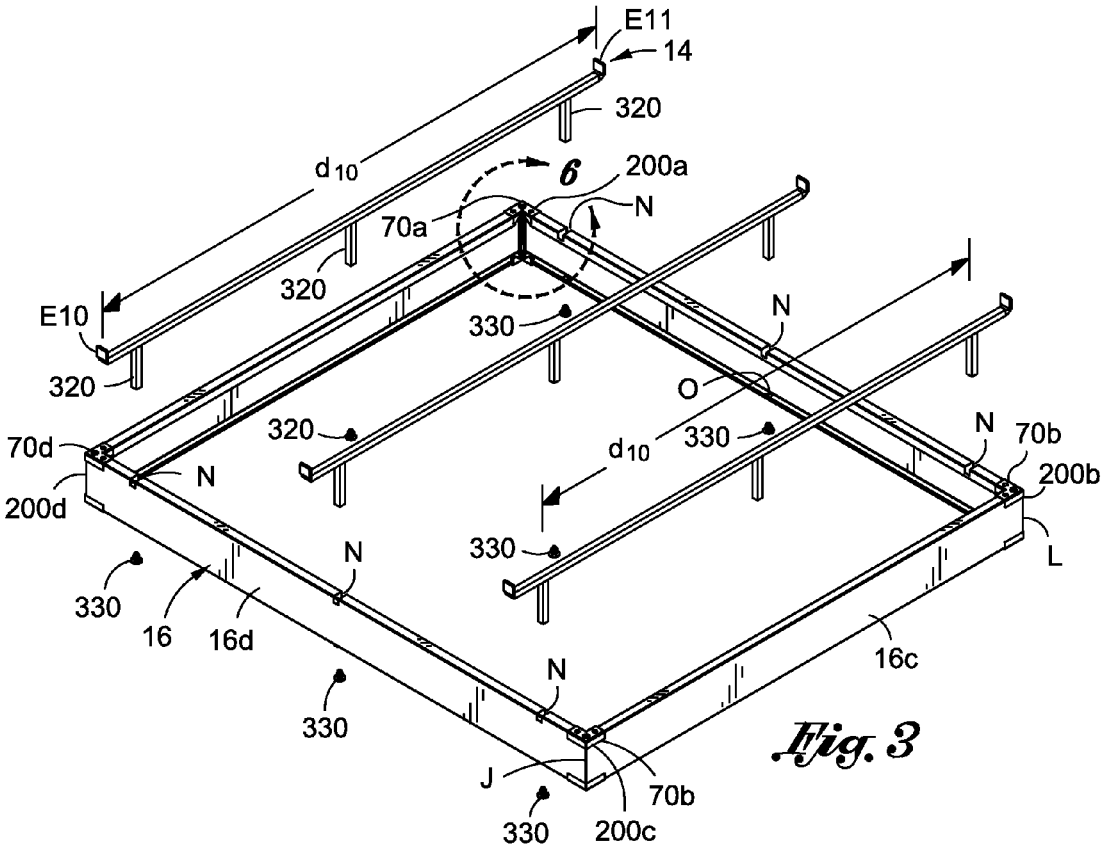
FIG. 3 is a partially exploded perspective view of the embodiment of my bed base shown in FIG. 1.
Figure 4:
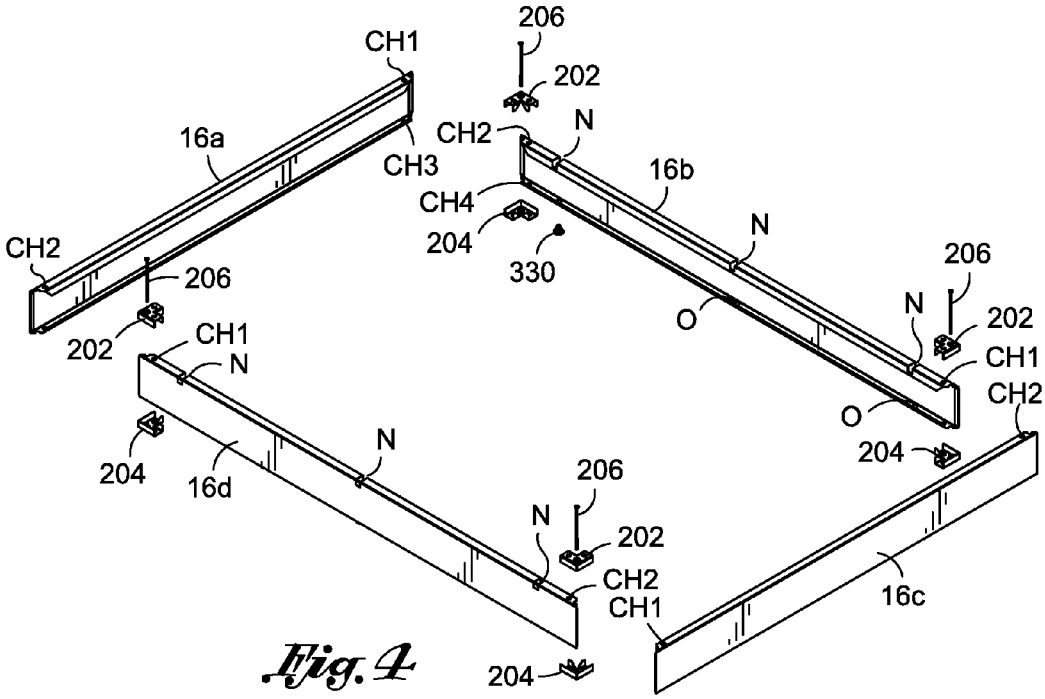
FIG. 4 is an exploded perspective view of the rectangular support of my bed base shown in FIG. 1.

As illustrated in FIG. 1, my bed base 10 includes three major structures: a rectangular support assembly 16, a corner connector assembly 12, and a cross-rail assembly 14, each of which is interactive with side members 16*a* through 16*d* to form my bed base for a box-spring mattress 18 shown in dotted lines in FIG. 2. One pair of substantially parallel side members 16*a* and 16*c* are separated by a predetermined distance d1 and another pair of substantially parallel side members 16*b* and 16*d* are separated by a predetermined distance d2. Adjacent side members 16*a* and 16*b*, 16*b* and 16*c*, 16*c* and 16*d*, and 16*d* and 16*a* are connected by a corner connector assembly 12, providing individual corner connectors 200*a*, 200*b*, 200*c*, and 200*d* in the respective corners 70*a*, 70*b*, 70*c*, and 70*d* of the rectangular support assembly 16. Three cross-rail assemblies 14 connect the opposed side members 16*b* and 16*d*. In general, the individual components of my bed base 10 are mainly made from metal tubes and sheet metal and formed using conventional stamping, welding, and bending techniques. The illustrated bed base 10 is sized to support a standard box-spring mattress 18.

In FIG. 1 the one embodiment of my bed base 10 is shown fully assembled. Kits of the disassembled components may be sold for different sizes, for example, twin, standard, queen, king and even custom size. The purchaser would assembly the components in the kits to make my bed base.

Rectangular Support Assembly

The rectangular support assembly 16 includes the four generally rectangular side members 16*a*, 16*b*, 16*c*, and 16*d* that are first assembled. The individual side members 16*a*, 16*b*, 16*c*, 16*d*, are preferably made from roll formed sheet steel having a thickness of from about 16 to about 20 gauge. The sheet steel is bent into the desired configuration using conventional manufacturing equipment. The opposed side members 16*b* and 16*d* are of the same length of about 71 inches and they typically do not vary no matter what the size of the box-spring and mattress being supported. Depending on the size of the box-spring and mattress being supported, the opposed side members 16*a* and 16*c* have a length ranging from about 26 to about 63 inches. For any type of box-spring and mattress being supported, the opposed side members 16*a* and 16*c* are of the same length. For example, when a twin size box-spring and mattress is being supported, the length is 26 inches, when a full size box-spring and mattress is being supported, the length is 40 inches, when a king size box-spring and mattress is being supported, the length is 58 inches. All the side members 16*a*, 16*b*, 16*c*, and 16*d*, are of the same width×ranging from about 5 to about 18 inches.

Figure 5A:
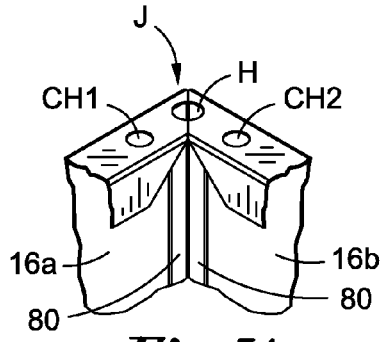
FIG. 5A is an enlarged, fragmentary perspective view showing mitered ends of connected side members.
Figure 5B:
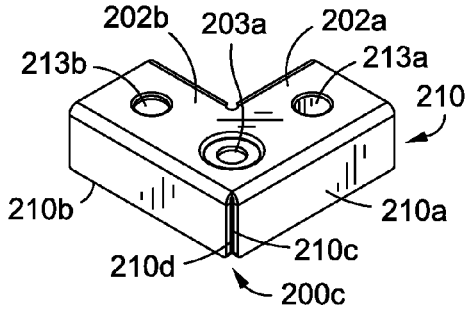
FIG. 5B is an enlarged, fragmentary perspective view showing the backside of a top plate member of a corner connector.
Figure 5:
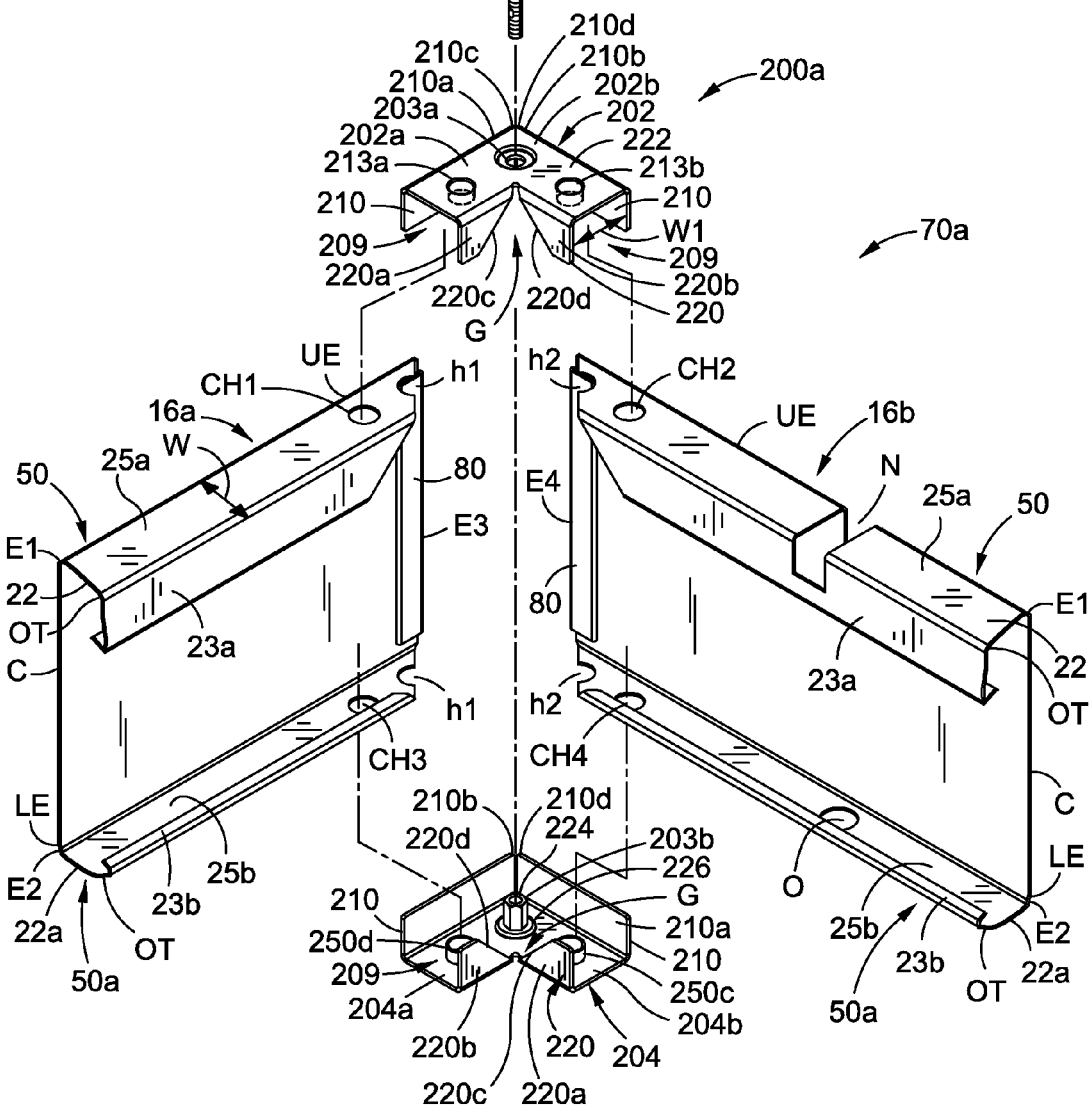
FIG. 5 is an enlarged, fragmentary exploded perspective view of one corner of my bed base shown in FIG. 1.
Figures 6, 6A:
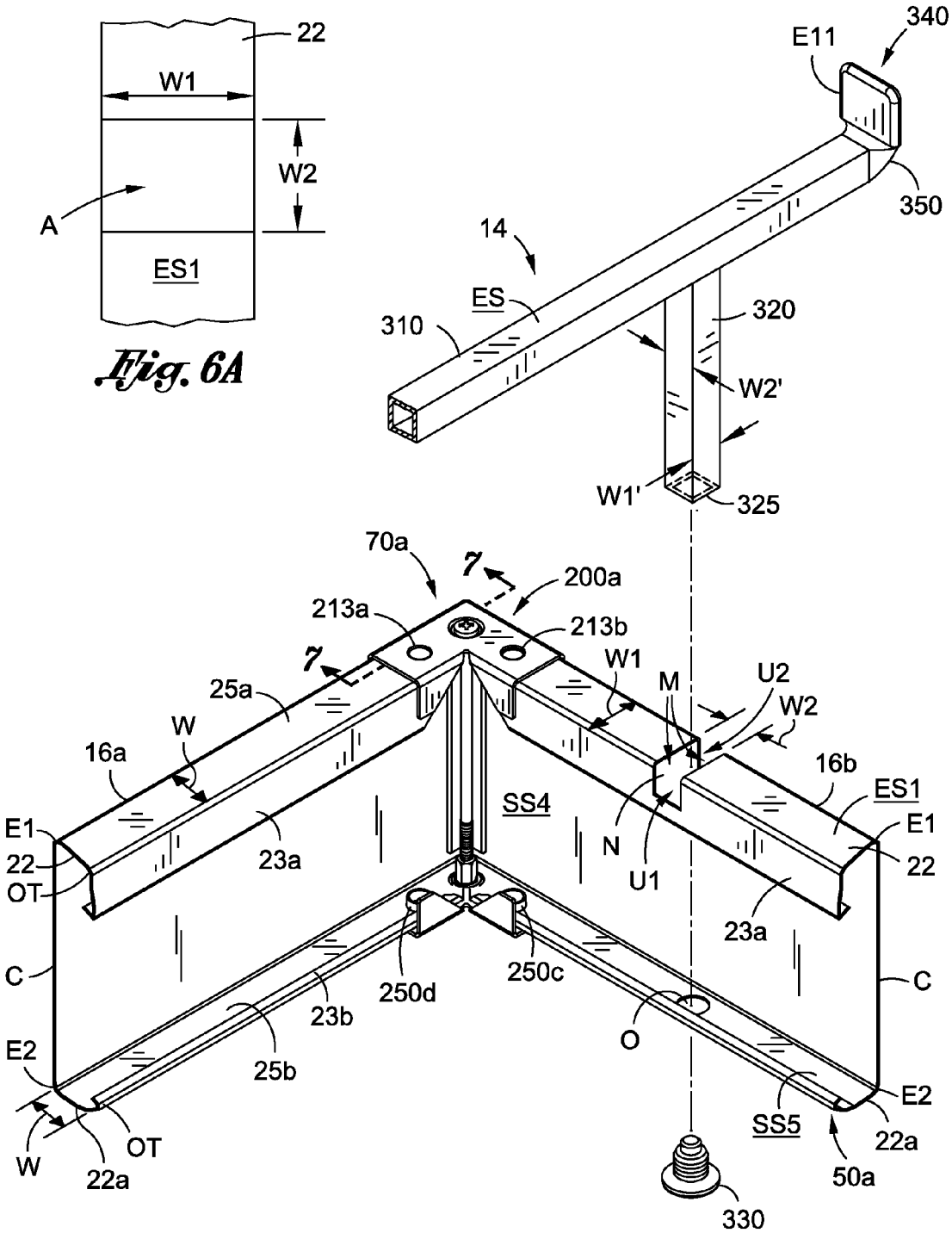
FIG. 6 is an enlarged, fragmentary exploded perspective view taken along line 6 of FIG. 3 of one embodiment of my cross-rail assembly of my bed base shown in FIG. 1.
FIG. 6A is an enlarged, fragmentary plan view of a top planar portion of a side member.

As best shown on FIGS. 5 and 6, each individual side member 16*a*, 16*b*, 16*c*, and 16*d* has a generally C-shaped cross-sectional configuration comprising a central, longitudinally extending, planar portion C with opposed edges E1 and E2. The opposed ends E3 and E4 of each individual side member 16*a*, 16*b*, 16*c*, and 16*d* are mitered, that is, cut inward at an angle of substantially 45-degrees to enable the formation of a miter joint J at each corner 70*a*, 70*b*, 70*c*, and 70*d* of the adjoining adjacent ends E3 and E4 of the adjacent side members 16*a* and 16*b*, 16*b* and 16*c*, 16*c* and 16*d*, 16*d* and 16*a*. To provide greater rigidity the opposed edges E3 and E4 each include an inwardly folded rectangular portion 80 formed from the planar portion C.

There extends outward in the same direction, respectively from each edge E1 and E2, 22 an L-shaped shoulder support/stiffener 50 and 50*a*. The support stiffeners 50 and 50*a* face each other, with their feet 23*a* and 23*b* pointing at each other and their legs 25*a* and 25*b* oriented horizontally to form longitudinal, planar support members 22 and 22*a*. Each leg 25*a* or 25*b* is at a right angle to the planar portion C. The individual feet 23*a* and 23*b* extend from an outer tip OT of the leg 25*a* or 25*b*. Each longitudinal support member 22 and 22*a*, or leg 25*a* and 25*b* has substantially the same width W, typically from about ¾ to about 1¼ inches. The length of each individual leg 25*a* and 25*b* is usually the same as the length of the side member 16*a*, 16*b*, 16*c*, or 16*d* from which it extends.

Figure 8:
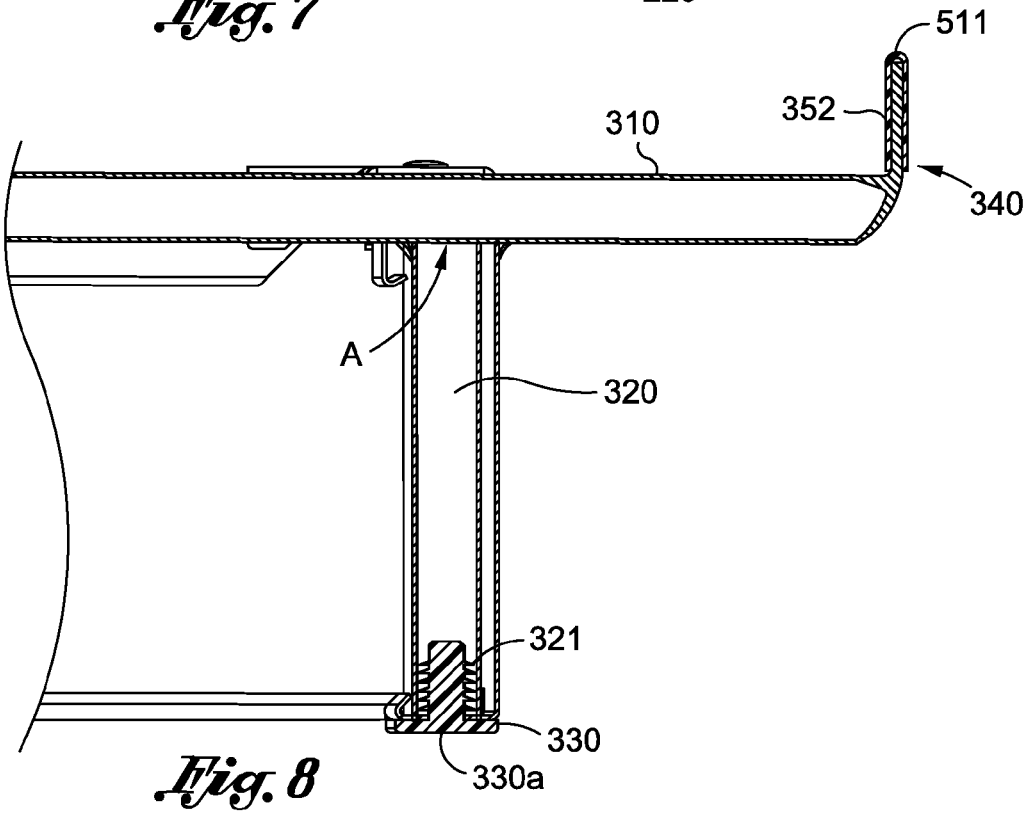
FIG. 8 is a cross-sectional view taken along line 8-8 of FIG. 1.

In the individual side members 16*b* and 16*d* there are three cut out notches N, located on the upper planar support member 22 of the L-shaped shoulder support/stiffener 50, spaced apart a distance which varies depending on the size of the box-spring and mattress being supported. Each individual pair of notches N is set back from the closest end E3 or E4, as the case may be, by an equal distance, typically from about 6 to 12 inches. As shown in FIGS. 6, 6A and 8, the notches N are open along the upper planar support member 22 and form a guide-way and surrounding support structure for an individual leg member 320 passing through an aperture A in the upper planar support members 22. Each notch N partially extends into the foot 23*a* as well as partially through the planar portion C of a side member to form the aperture A. This aperture A has essentially the same overall configuration and dimensions as the cross-section of the leg member extending therethrough. For example, as illustrated in FIGS. 6 and 6A, the rectangular leg member 320 has one side with a width W2' (FIG. 6) equal to the width W2 of the aperture A and another side with a width W1' (FIG. 6) equal to the width W1 of the aperture A. When the leg member 320 is rectangular, the notches N each comprise a pair of substantially U-shaped cut-a-way sections U1 and U2 of the same configuration and dimensions, one cut-a-way section U1 in the foot 23*a* and the other cut-a-way section U2 in the planar portion C of a side member. The spaced apart open mouths M of the cut-a-way sections U1 and U2 form the aperture A.

As depicted in FIG. 6, there are three cut out openings O, located on the lower planar support member 22*a* of the L-shaped shoulder support/stiffener 50*a*, spaced apart a distance which varies depending on the size of the box-spring and mattress being supported. In each side member 16*b* and 16*d*, the individual notches N and openings O are in vertical alignment with each other. Upon assembly of my bed base 10, the notches N in the side member 16*b* are aligned with and in registration with the notches N in the side member 16*d*.

Near the ends E3 and E4 of the individual side members 16*a*, 16*b*, 16*c*, and 16*d* there are cut out holes CH1, CH2, CH3, and CH4. The cut out holes CH1 and CH2 are punched through the upper planar support member 22 while the cut out holes CH3 and CH4 are punched through the lower planar support member 22*a*. Each cut out hole CH1 and CH2 is interactive with cylindrical post locator elements (not shown) of an upper plate member 202 of a corner connector assembly 12 and each cut out hole CH3 and CH4 is interactive with cylindrical post locator elements 250*c* and 250*d* of the lower plate member 204. As discussed below, aligned holes H are formed in each corner 70*a* through 70*d* at the joint J, allowing an elongated post 206 to pass from plate 202 to 204, securing these plates together.

As best shown in FIGS. 5 and 5A, in the adjacent side members 16*a* and 16*b* is a cut-a-way h1 in each of the legs 25*a* and 25*b* of the side member 16*a* and a cut-a-way h2 in each of the legs 25*a* and 25*b* of the side member 16*b*. The cut-a-ways h1 and h2 are each ½ of a complete hole H that is created by connecting the mitered adjacent ends E3 and E4 of the side members 16*a* and 16*b* so they abut each other as depicted in FIG. 5A. For example, the hole H may be circular and the cut-a-ways h1 and h2 may be semicircular. Because the side members 16*a*, 16*b*, 16*c*, 16*d* are so designed as discussed above, the opposed pairs of side members 16*a* and 16*c*, and 16*b* and 16*d*, are mirror images.

Corner Connector Assembly

Figure 7:
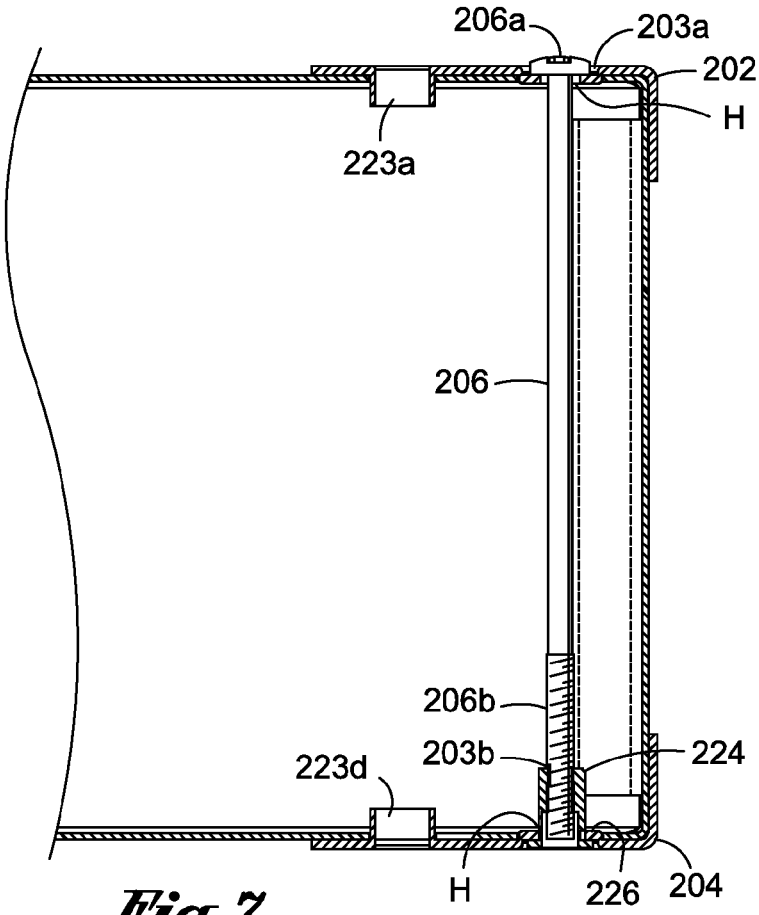
FIG. 7 is a cross-sectional view taken along line 7-7 of FIG. 6.

Identical corner connector assemblies 12 are used so my bed base 10 has respectively at each of its corners 70*a* through 70*d* identical corner connectors 200*a*, 200*b*, 200*c*, and 8200*d*. For example, as shown in FIGS. 5, 6, and 7 the corner connector 200*a* securely connects the adjoining, adjacent ends E3 and E4 of the side members 16*a* and 16*b* at the corner 70*a*. The four side members 16*a*, 16*b*, 16*c*, and 16*d* do not have any other connection device other than the identical corner connectors 200*a*, 200*b*, 200*c*, and 200*d* at their respective adjacent ends E3 and E4, which form and hold the corners 70*a* through 70*d* firmly together.

The corner connector 200*a* shown in FIGS. 5, 6, and 7 is illustrative of all the corner connectors 200*a*, 200*b*, 200*c*, and 200*d*. The illustrative corner connector 200*a* includes (a) a top plate member 202, (b) a bottom plate member 204 with an internally threaded tubular receptacle 224 (FIG. 7) connected via an annular flange 226 to the underside of the bottom plate 204, and (c) an elongated post 206 to securely join the top plate and bottom plate. The top plate 202 and the bottom plate 204 have substantially identical configurations and dimensions, for example, each includes a pair of arms 202*a*, 202*b* and 204*a*, 204*b* that are at a right angle to each other. The top plate 202 and the bottom plate 204 each have therein a right angle channel 209 and each include an outer right angle wall 210 and an inner right angle wall 220. The outer right angle wall 210 is opposed to and in registration with the inner right angle wall 220.

As best shown in FIG. 5B, the outer right angle wall 210 is divided into two sections 210*a* and 210*b* with adjacent ends 210*c* and 210*d* touching or almost touching. Upon assembly, the section 210*a* extends along an exterior surface of the planar portion C of the side member 16*a*, and the section 210*b* extends along an exterior surface of the planar portion C of the side member 16*b*. As best shown in FIG. 5, the top plate 202 has an inner right angle wall 220 that is divided into two sections 220*a* and 220*b* with a gap G between adjacent ends 220*c* and 220*d*. The section 220*a* extends along the foot 23*a* of the L-shaped support stiffener 50 of the side member 16*a*. The section 220*b* extends along the foot 23*b* of the L-shaped support stiffener 50 of the side member 16*b*. As best shown in FIG. 5, the bottom plate 204 has an inner right angle wall 220 that is divided into two sections 220*a* and 220*b* with a gap between adjacent ends 220*c* and 220*d*. The section 220*a* extends along the foot 23*a* of the L-shaped support stiffener 50*a* of the side member 16*a*. The section 220*b* extends along the foot 23*a* of the L-shaped support stiffener 50*a* of the side member 16*b*. The inner right angle wall 220, and the outer right angle wall 210 form the right angle channels 209 respectively in the top plate 202 and bottom plate 204 of the corner connector assembly 12. The channels 209 have widths W1 about equal to the width W of the L-shaped support stiffeners 50 and 50*a*.

The top plate 202 and bottom plate 204 each have therein holes 203*a* and 203*b* that are vertically aligned when the plates 202 and 204 are mounted at the ends E3 and E4 of the side members 16*a* and 16*b* and form the corner 70*a* as depicted in FIGS. 5 and 6. The plates 202 and 204 each include a pair of holes 213*a* and 213*b*, one hole in each arm of the plates. These holes 213*a*, and 213*b* are stamped through the plates 202 and 204. As shown in FIG. 5, this process produces cylindrical post locator projections 250*c* and 250*d* extending from the underside of the plates 202 and 204.

The right angle, adjoining adjacent ends E3 and E4 of the side members 16*a* and 16*b* are connected by the corner connector 200*a* with the top plate 202 and the bottom plate 204 positioned so their right angle channels 209 overlap these ends as shown in FIGS. 5 and 6. The cylindrical post locator projections 250*c* and 250*d* respectively engage and interlock with the cut out holes CH1 and CH2 in the upper planar support member 22 of the side members 16*a* and 16*b*, and with the cut out holes CH3 and CH4 in the lower planar support member 22*a* of the side members 16*a* and 16*b*. The elongated post 206 couples together the top plate 202 and the bottom plate 204. The elongated post 206 extends between the plates, 202 and 204, and is positioned through a hole H that is created by adjoining the mitered adjacent ends E3 and E4 of the corner 70*a*.

As illustrated in FIG. 5, the elongated post 206 has an enlarged head end 206*a* of greater diameter than the hole 203*a* and a threaded lower end 206*b*. Upon assembly, the post 206 passes through the hole 203*a* and the enlarged head end 206*a* bears against an exterior surface of the top plate 202. As depicted in FIG. 7, the threaded lower end 206*b* is screwed into an internally threaded tubular receptacle 224, that has been forced fitted into the hole 203*b* in the bottom plate 204. The receptacle 224, located on the underside of the bottom plate 204, has an annular flange 226 (FIG. 5) projecting outward from a side of the receptacle The flange 226 assists in securing the tubular receptacle 224 to the bottom plate 204. The length of the post 206 is sufficient so that its threaded lower end 206*b* extends into the cylindrical tubular receptacle 224.

During assembly of the bed base 10, the plates 202 and 204 are respectively mounted on the upper edge UE and lower edge LE of the adjacent side members 16*a* and 16*b*, 16*b* and 16*c*, 16*c* and 16*d*, 16*d* and 16*a*, thus forming the individual corners 70*a* through 70*d* of the rectangular support structure 16. The right angle channels 209 of the top plate 202 and bottom plate 204 respectively receive therein the upper edge UE and lower edge LE, including the leg support members 25*a* and 25*b* of the planar support member 22 and the foot support member 23*b* of the planar support member 22*a*. The top plate 202 overlaps the upper edge UE of the adjacent side member's 16*a* and 16*b* and the bottom plate 204 overlaps the lower edge LE of the adjacent side members 16*a* and 16*b*. As the threaded end 206*b* of the post 206 is screwed into the cylindrical tubular receptacle 224, the top plate 202 and bottom plate 204 are connected together and drawn towards each other so these plates each bear snugly against the edges UE and LE including the upper planar support member 22 and lower planar support member 22*a* of the adjacent side members 16*a* and 16*b*, thus forming the individual corner connector 200*a* of the corner 70*a*. The planar support members 22 and 22*a*, having widths equal to the width of the channels 209, fit snug within the channels 209.

Cross-Rail and Side Member Assembly

As best illustrated in FIG. 6, each cross-rail assembly 14 comprises an elongated bar member 310 and three leg members, opposed outer leg members 320 and an optional third leg member 320*a* centered approximately in the middle of the elongated bar member 310. The bar member 310 and leg members 320 and 320*a* may each have substantially rectangular cross-sectional configuration of the same dimensions. Each individual leg member of the pair of leg members 320 is located near the elongated bar member's 310 opposed ends E10 and E11. The leg members 320 and 320*a* all project in the same direction at a right angle to the elongated bar member 310. The leg members 320 and 320*a* are of substantially the same length and each leg terminates at an open lower end 325. The elongated bar member 310 terminates at opposed ends E10 and E11 in a stop element 340. The stop element 340 is shaped in the form of an L-shaped arm 350. The stop element 340 is separated by a distance greater than the predetermined distance between the opposed side members 16*b* and 16*d* to accommodate the box-spring mattress 18. The L-shaped arm 350 of the stop element 340 prevents the box-spring mattress 18 from sliding off the bed base 10.

FIGS. 6 and 6A best illustrate the configuration and dimensional relationship between a notch N and an individual leg member 320 received within the notch. For example, an individual notch N in the side members 16*b* and 16*d* is sized and configured to receive both the elongated bar member 310 and an individual leg member 320. For example, with the elongated bar members 310 and the individual leg members 320 substantially rectangular and of substantially the same dimensions, the depth, breath, and shape of each notch N enables the elongated bar member 310 to fit snug within the notch N and horizontally oriented with an individual leg member 320 projecting through an upper planar support member 22 and extending downward to the opening O in the lower planar support member 22*a*. This arrangement of components and their configuration and dimensions, creates an exposed exterior surface ES of the elongated bar member 310 that is substantially flush with an exterior surface ES1 of the upper planar support member 22 located on the side members 16*b* and 16*d*, resulting in a flush surface FS (FIG. 1) supporting the box-spring mattress 18. This allows the box spring mattress 18 to lay flat on top of the planar support members 22 of the rectangular support structure 16.

As illustrated in FIGS. 1 and 6, when the cross-rail assembly 14 is placed at a right angle to the side members 16*b* and 16*d*, individual leg members 320 in each cross-rail assembly 14 pass through an individual notch N in the planar support member 22 and fit snugly against the interior surfaces of SS4 of the side members 16*b* and 16*d*. The leg members 320, which are within the support assembly 16, are separated by a distance d2 that is substantially equal to the predetermined distance between internal surfaces of the opposed side members 16*b* and 16*d*. Because of their length, rigidity, and position immediately adjacent the interior surface SS4 of the side members 16*b* and 16*d*, the leg members 320 provide support for the side members 16*b* and 16*d* so that, even through these side members are of thin sheet metal, they do not buckle. With the individual openings O aligned with individual notches N, the lower ends 325 of the leg members 320 are then next to an interior surface SS5 of the lower planar support member 22*a*. As shown in FIG. 8, a slider element 330 passing through an opening O is screwed into a threaded internal element 321 in the open lower ends 325 of the leg members 320. My bed base 10 rests on an external surface 330*a* of the slider element 330 upon assembly and is oriented substantially horizontally.

Figure 9:
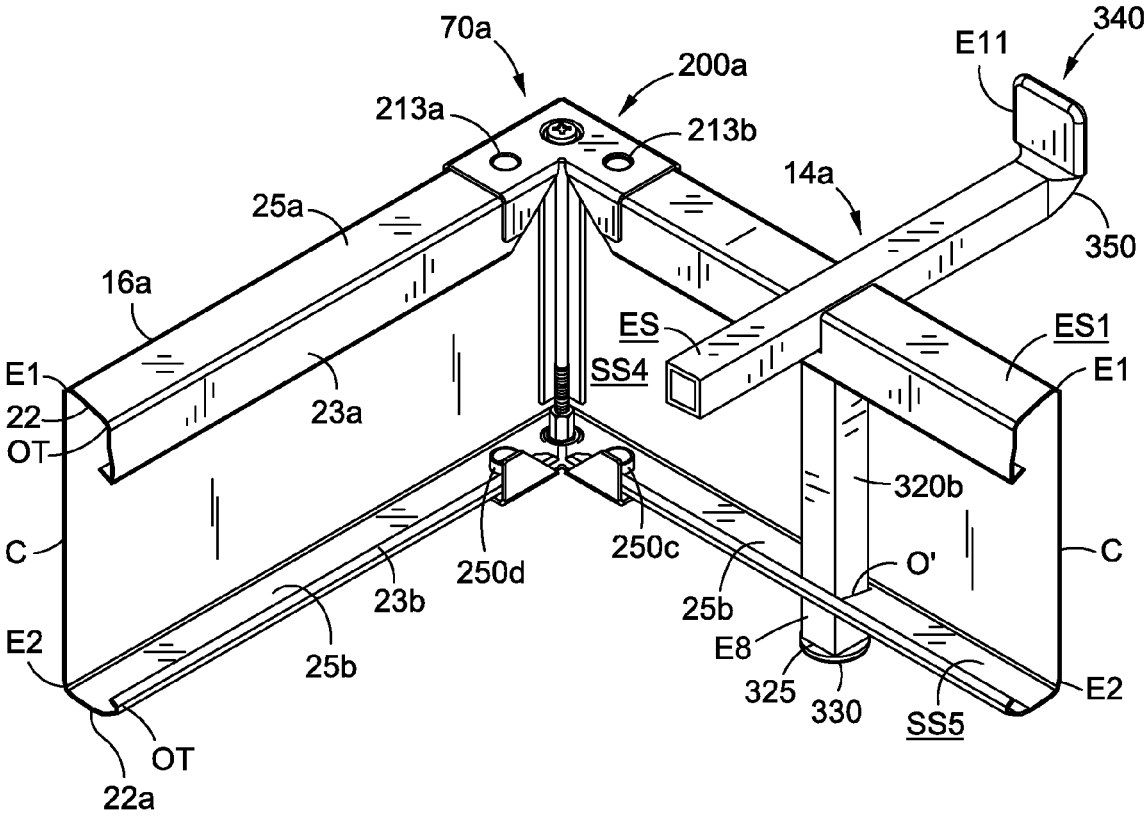
FIG. 9 is an enlarged, fragmentary perspective view of another embodiment of my cross-rail assembly with its leg member extending through a stiffener leg.

As shown in FIG. 9, an alternate embodiment of my cross rail assembly 14*a* has a leg member 320*b* with a terminal end E8 that extends a very slight distance through a rectangular opening O' in the lower planar support member or stiffener leg 25*b*. The dimensions of the rectangular opening O' are slightly greater than the rectangular perimeter of the leg member 320*b*. A slider element 330 is connected to the terminal end E8.

My corner connector assembly and combination of the cross-rail assembly and opposed side members are illustrated in the same embodiment, namely, my bed base 10. My corner connector assembly and cross-rail assembly-side members combination may, however, be used independently of each other.

SCOPE OF THE INVENTION

The above presents a description of the best mode I contemplate of carrying out my bed base, and of the manner and process of making and using it, in such full, clear, concise, and exact terms as to enable any person skilled in the art to which it pertains to make and use my bed base. My bed base is, however, susceptible to modifications and alternate constructions from the illustrative embodiment discussed above which are fully equivalent. Consequently, it is not the intention to limit my bed base to the particular embodiment disclosed. On the contrary, my intention is to cover all modifications and alternate constructions coming within the spirit and scope of my bed base as generally expressed by the following claims, which particularly point out and distinctly claim the subject matter of my invention:

The invention claimed is:

1. A bed base comprising a rectangular support having side members where corners are formed by adjacent side members and a pair of said side members are opposed and separated by a predetermined distance, a pair of cross-rails, each cross-rail including (a) an elongated bar member that has opposed ends and (b) a pair of leg members, one leg member at or near each opposed end of said elongated bar member, said leg members being separated by a distance substantially equal to said predetermined distance between the opposed side members, each side member having opposed upper and lower edges with an upper planar support member along said upper edge and a lower planar support member along said lower edge, each said upper and lower planar support member extending inwardly substantially at a right angle to the side member from which said planar support member extends, a rectangular notch in each opposed side member, each notch extending through said upper planar support member and into the side member from which said upper planar support member extends, said bar member and leg members each having a substantially rectangular cross-sectional configuration and each said notch being sized and configured to receive the bar member so the bar member fits snug within the notch with an exposed upper exterior substantially planar surface of the elongated bar member being substantially flush with an exposed upper exterior substantially planar of the upper planar support member, each said lower planar support member having therein an opening, each said opening aligned with one notch in the upper planar support member, and said side members being aligned so the notch in one side member is in registration with the notch in the opposed side member and each cross-rail is seated in opposed, aligned notches with the elongated bar member of each cross-rail extending between the opposed side members and each said leg member of a cross-rail projecting through an upper planar support of one side member and terminating at a lower end in a slider element that is next to an exterior surface of the lower planar support member, and a corner connector assembly connecting said adjacent side members, said corner connector assembly including a pair of plate members, each said plate member including a pair of arms at a right angle, each arm having outer wall elements along outer edges of the arm that are substantially at a right angle to each other and to the arm and inner wall elements along inner edges of the arm that are substantially at a right angle to each other and to the arm, said inner and outer wall elements forming a right angle channel in the corner connector, and a locator element in each arm of the plate member that engages and interlocks with a locator element in each end of the adjacent side members, and an elongated post member extending between the plate members and attaching said plate members.

2. A bed base comprising a rectangular support having corners formed by adjacent side members, at least one pair of said side members being opposed and separated by a predetermined distance, a cross-rail including (a) an elongated bar member that has opposed ends and (b) a pair of leg members, one leg member at or near each opposed end of said elongated bar member, said leg members being separated by a distance substantially equal to said predetermined distance between the opposed side members, each side member having opposed upper and lower edges with an upper planar support member along said upper edge and a lower planar support member along said lower edge, each said upper and lower planar support member extending inwardly substantially at a right angle to the side member from which said planar support member extends, a notch in each opposed side member, each notch extending through said upper planar support member and into the side member from which said upper planar support member extends, said adjacent side members each having a mitered end in the upper and lower planar support members and in each mitered end a cut-a-way section, said cut-a-way sections each comprising a portion of a complete hole created by connecting the adjacent side members so the mitered ends abut each other, each said bar member having a predetermined configuration and each said notch being sized and configured to receive the bar member so the bar member fits snug within the notch, each said lower planar support member having therein an openings, each said opening aligned with the notch in the upper planar support member, said opposed side members being aligned so the notch in one side member is in registration with the notch in the other side member and each cross-rail is seated in opposed, aligned notches with the elongated bar member of the cross-rail extending between the opposed side members and each said leg member of the cross-rail projecting through an upper planar support of a side member and terminating at a lower end in a slider element that is next to an exterior surface of a lower planar support member, and a corner connector assembly at each corner, each connector assembly including a pair of aligned plate members, each plate member including a pair of arms at a right angle to each other and each arm having a channel therein and said channels being at a right angle with respect to each other, said channels receiving individual planar support members of the side members, a locator element stamped in each arm of each plate member to form a locator projection extending from an underside of the arm in which said locator projection is formed, said locator projection engaging and interlocking with a locator hole in each end of the adjacent side members forming a corner of the bed base, a connector hole in one plate member where the arms of said one plate member meet to form the right angle of the channel, and a threaded receptacle in the other plate member where the arms of said other plate member meet to form the right angle of the channel, said connector hole and receptacle being vertically aligned when the plate members are mounted to the side members to form the corner of the bed base, and a post member for attaching the plate members together, said post member having a threaded end that passes through the connector hole in one aligned plate member and the complete holes along the mitered ends and screws into the threaded receptacle in the other aligned plate member.

* * * * *